US005652600A

United States Patent [19]

Khormaei et al.

[11] Patent Number: 5,652,600

[45] Date of Patent: Jul. 29, 1997

[54] TIME MULTIPLEXED GRAY SCALE APPROACH

[75] Inventors: Iranpour Khormaei, Beaverton; Christopher N. King, Portland, both of Oreg.

[73] Assignee: Planar Systems, Inc., Beaverton, Oreg.

[21] Appl. No.: 341,404

[22] Filed: Nov. 17, 1994

[51] Int. Cl.[6] ..... G09G 3/30

[52] U.S. Cl. ..... 345/76

[58] Field of Search ..... 345/77, 92, 205, 345/76

[56] References Cited

U.S. PATENT DOCUMENTS

| | | | |
|---|---|---|---|
| 4,733,228 | 3/1988 | Flegal | 340/719 |
| 4,782,340 | 11/1988 | Czubatyj et al. | 345/92 |
| 5,302,966 | 4/1994 | Stewart . | |
| 5,495,352 | 2/1996 | Shinjo et al. | 359/54 |

OTHER PUBLICATIONS

"32.2: Charge Modulation Gray–Scale Method with Profiled Current Pulses for ACTFEL Displays " by M.H. Aberg, VTT Technical Research Centre of Finland, Semiconductor Laboratory, Espoo, Finland, SID 93 Digest, pp. 765–768.

"19.5: Electrical Characterization and Modeling of ZnS:Mn ACTFEL Devices with Various Pulse Waveforms" by A.A. Douglas, J.F. Wager, Oregan State University, Corvallis, OR, SID 92 Digest, pp. 356–359.

"16–Level Gray–Scale Driver Architecture and Full –Color Driving for TFT–LCD" by K. Takahara, T. Yamaguchi, M. Oda, H. Yamaguchi, M. Okabe, Fujitsu Limited, Atsugi, Japan, 1991 IEEE, pp. 115–118.

"11.3: High–Resolution Active–Matrix Electroluminescent Display" by R. Khormael, S. Thayer, K. Ping, C. King, Planar Systems, Beaverton, OR; G. Dolny, A. Ipri, F–L. Hsueh, R. Stewart, David Sarnoff Research Center, Princeton, NJ; T. Keyser, G. Becker, D. Kagey, Allied Signal Aerospace Corp., Columbia, MD; amd M. Spitzer, Kopin Corp., Taunton, MA; SID 94 Digest, p. 137, 3 pages.

"A 6x6–in 20 lpi Electroluminescent Display Panel" by T.P. Brody, F.C. Luo, Z.P. Szepesi, and D.H. Davies, Westinghouse Research Laboratories, Pittsburgh, PA, IEEE Transactions on Electron Devices, vol. Ed–22, No. 9, Sep. 1975, pp. 739–748.

"16.4: TFEL Character Module Using a Multilayer Ceramic Substrate", K. Nunomura, Y. Sano, and K. Utsumi, NEC Corporation, Kanagawa, Japan; S. Sakuma, NEC Kansai, Ltd., Shiga, Japan, SID 87 Digest, pp. 299–302.

ACTA Polytechnica Scandinavica, Electrical Engineering Series No. 74, "An Electroluminescent Display Simulation System and its Application for Developing Grey Scale Driving Methods" by Markku Aberg, Helsinki 1993.

(List continued on next page.)

*Primary Examiner*—Mark R. Powell

*Attorney, Agent, or Firm*—Chernoff, Vilhauer, McClung & Stenzel

[57] ABSTRACT

A method of illuminating an active matrix EL device (AMEL) to provide a gray scale display. The device comprises a first electrode layer comprising an active matrix of individually adjustable pixel electrodes, a second electrode layer, and a thin film EL laminate stack including at least an EL phosphor layer and a dielectric layer, and the stack being disposed between the first and second electrode layers. The gray scale display is illuminated by the steps of, energizing a first set of selected ones of the pixel electrodes with data signals during a first subframe time period. Selected pixels are illuminated by driving the second electrode layer during the first subframe time period a first illuminating signal having predetermined characteristics including frequency, amplitude, wave shape and time duration. Thereafter, a second set of selected ones of the pixel electrodes are energized with data signals during a next subframe time period. Selected pixels are again illuminated during the next time period with an altered illumination applied to the second electrode signal wherein one or more of the predetermined characteristics differ from the first illuminating signal.

12 Claims, 7 Drawing Sheets

OTHER PUBLICATIONS

"4.6: High–Performance Column Driver for Gray–Scale TFEL Displays" by S.A. Steiner, H.Y. Tsoi; Supertex, Inc., Sunnyvale, California, at least one year to prior to filing date.

"37.1: A 31–in.–Diagonal Full–Color Surface–Discharge ac Plasma Display Panel" by S. Kanagu, Y. Kanazawa, T. Shinoda, K. Yoshikawa, T. Nanto; Fujitsu Ltd., Akashi City, Japan, SID 92 Digest, p. 713, 4 pages.

"19.2: Late–News Paper: The Fabrication of TFEL Displays Driven by a–Si TFTs" by T. Suzuki, Y. Uno, J. Sakurai, Y. Sato, S. Kyozuka, N. Hiji, T. Ozawa; Fuji Xerox Co., Ltd., Kanagawa, Japan, SID 92 Digest, pp. 344–347.

"Evaluation of a 64X64 CdSe TFT Addressed ACTFEL Display Demonstrator" by J. Vanfleteren, J. Capon, J. De Baets, I. De Rycke, H. De Smet, J. Doutreloigne, A. Van Calster, P. De Visschere; Laboratory of Electronics, University of Gent, Sint–Pietersnieuwstraat 41, B–9000 Gent, Belgium, 1991 IEEE, pp. 134–136.

"High–Voltage TFT Fabricated in Recrystallized Polycrystalline Silicon" by Takashi Unagami, Osamu Kogure, IEEE Transactions on Electron Devices, vol. 35, No. 3, Mar. 1988, pp. 314–319.

"MOS–EL Integrated Display Device" by Ken–ichi Oki, Yasushi Ohkawa, Kazuhiro Takahara, Shoshin Miura; Fujitsu Laboratories, Ltd., Kobe, Japan, SID 1982, pp. 245–246.

"Thin–Film Transistor Switching of Thin–Film Electroluminescent Display Elements" by Z.K. Kun, F.C. Luo, J. Murphy; Westinghouse Research and Development Center, Pittsburgh, Pennsylvania, SID vol. 21, 1980, pp. 236–242.

TIME MULTIPLEXED GRAY SCALE APPROACH

BACKGROUND OF THE INVENTION

The present invention relates to a thin film electroluminescent device using an improved modulation technique for providing a gray scale display.

Traditional thin film electroluminescent displays (TFEL) are typically constructed of a laminar stack comprising a set of transparent front electrodes, which are typically made of indium tin oxide, formed on a transparent substrate (glass), and a transparent electroluminescent phosphor layer sandwiched between front and rear dielectric layers situated behind the front electrodes. Disposed behind the rear dielectric layer are rear electrodes orientated perpendicular to the front electrodes. To illuminate an entire display, each row electrode is sequentially scanned and selected column electrodes are simultaneously energized with voltage pulses to illuminate selected pixels in a row. All rows are scanned in turn until the entire display has been illuminated thereby writing a frame of video data. This is sometimes referred to as a frame time addressing.

For monochrome and color displays a gray scale is a desirable feature in order to display video and graphic images with better screen clarity and definition. Current techniques to achieve a gray scale for thin film electroluminescent displays can be broadly categorized as those calling for modulation of the amount of charge flow through the phosphor layer. The present modulation techniques may be further divided into two subcategories, namely, amplitude modulation and pulse width modulation. These techniques have been used with traditional electroluminescent displays to achieve a gray scale.

Amplitude modulation is the modulation of the magnitude of the voltage pulses imposed across the electroluminescent layer. Different voltage pulse magnitudes within the operating range of the electroluminescent layer, which is typically 160 volts to 250 volts, cause different pixel brightnesses. Within certain limits a higher voltage pulse causes a greater amount of light to be emitted than a lower voltage pulse. Pulse width modulation is a single voltage pulse of a selected time duration imposed across the electroluminescent layer during each frame time to control the amount of light emitted from the pixel, which increases with increased duration of the voltage pulse. Both of these techniques are readily applied to an entire display by applying a voltage pulse to a row electrode and using varied magnitudes or duration of voltage pulses applied to the column electrodes thereby creating a gray scale display in a row by row manner.

Both of these modulation techniques control the charge transported through the electroluminescent layer to achieve a gray scale display, but the resultant optical performance and accuracy obtainable is not sufficient for the high number of luminescence levels desired in a true high resolution gray scale display. The electroluminescent layer has a nonlinear voltage versus luminescence curve that makes it difficult to obtain a desired luminescence output from the electroluminescent layer with different applied voltage pulse levels. Even if the applied voltage pulse levels are modified in some manner to compensate for such nonlinearities, the voltage versus luminescence curve tends to shift from location to location within a display and also varies from display to display. Additionally, individual pixels within the display may exhibit a voltage coupling to other pixels, which changes the actual voltage at a particular pixel, thereby changing the luminescence of the selected pixel. Furthermore, the voltage coupling varies with the particular pattern of voltages supplied to the entire display at any particular moment. The voltage coupling and the nonlinear voltage versus luminescence curve are especially prominent at low and intermediate voltage levels. These problems make it difficult to design displays with a high gray scale which requires accurate luminescence levels.

The refresh rates obtainable with traditional thin film electroluminescent displays are limited by the time required to address and illuminate each row within the display in a sequential manner by providing a single voltage pulse to a row electrode and a voltage pulse to selected column electrodes. After an entire display is refreshed by addressing and illuminating each selected pixel in a row by row manner, the process is repeated. The illumination rate (the rate at which voltage pulses are applied across the electroluminescent layer of the entire display to illuminate each pixel) is limited by the time required to address each pixel in a row-by-row manner, because the illumination and addressing functions of the display are combined. A typical display is refreshed at 60 Hz. Thus, frequency modulation techniques are not easily adaptable to conventional drive techniques because if the refresh rate falls too low, flickering will result and higher frame rates are limited by the RC time constants of the display.

Gray scale has been available for plasma displays which have a memory characteristic that is not present in thin film electroluminescent displays. A high voltage pulse, typically of 200 volts, is imposed on a pixel to cause the pixel of the plasma display to emit light. Thereafter, a sustaining signal, typically of 180 volts, is imposed on the pixel to maintain the emission of light from the pixel. While the pixel is emitting light, the frequency of the sustaining signal may be chosen to cause the pixel to emit the desired luminescence. However, if the sustaining signal is imposed on the pixel without an immediately prior high voltage pulse, the pixel will not emit light. Thus, the plasma display relies upon the inherent memory of the plasma medium to make gray scale possible. Gray scale approaches used for plasma display are not readily adaptable to TFEL displays, because the electroluminescent layer of TFEL displays do not exhibit the requisite memory characteristics of plasma displays.

What is desirable then, is a modulation scheme for TFEL displays to achieve more accurate luminescence levels, whereby, the effects of the nonlinear voltage versus luminescence curve are minimized, the effects of the voltage coupling are reduced, and which does not sacrifice the panel's high illumination rates.

SUMMARY OF THE PRESENT INVENTION

The present invention overcomes the aforementioned drawbacks of the prior art by providing a method of illuminating an active matrix EL device (AMEL) to provide a gray scale display. The device comprises a first electrode layer comprising an active matrix of individually addressable pixel electrodes, a second electrode layer, and a thin film EL laminate stack including at least an EL phosphor layer sandwiched between a pair of dielectric layers, the stack being disposed between the first and second electrode layers. The gray scale display is created by dividing a data frame into subframe time periods and altering the illuminating signal from subframe to subframe while selectively illuminating pixels during each subframe. The differences in illuminating signals provide differences in pixel luminescence levels. This method includes the steps of energizing, or in other words selecting, a first set of selected ones of the pixel electrodes with data signals during a first subframe time period, and illuminating selected pixels by driving the second electrode layer during the first subframe time period with a first illuminating signal having predetermined characteristics including frequency, amplitude, wave shape and time duration. Thereafter, a second set of selected ones of the pixel electrodes are energized with data signals during a next subframe time period. Selected pixels are again illuminated by driving the second electrode layer during the next subframe time period with an altered illuminating signal wherein one or more of the predetermined characteristics differ from the first illuminating signal.

This modulation scheme permits all of the individual pixels within the display to be addressed at one time with data bits representative of whether the respective pixels should be illuminated. The entire display is illuminated with an illuminating signal during a first subframe time period preferably by a series of voltage pulses applied to the entire display. Thereafter, the process is repeated with a second set of data bits and the entire display is illuminated with the illuminating signal for a next subframe time period wherein a characteristic of the illuminating signal such as frequency, time duration or amplitude is changed. By changing the illuminating signal characteristic between subframe time periods, a gray scale display is easily achieved because the change in illuminating signal characteristics may directly influence luminescence. Furthermore, in the present invention the illumination and addressing functions are not coupled, thereby permitting high illumination rates that were not previously obtainable.

In a preferred embodiment of the present invention, the voltages imposed across the electroluminescent phosphor layer have a magnitude near the upper end of the luminescence versus voltage curve (e.g., 200 volts or 160 volts, depending upon display design) which results in a more predictable luminescence from location to location within a display and from display to display, than using low and intermediate voltages. Also, such voltages reduce the effects of the voltage coupling between pixels. This permits much greater control over pixel luminescence allowing a higher number of gray scale levels to be achieved.

According to one embodiment, the subframe time periods are unequal and are arranged to provide a four bit gray scale. The most significant bit is represented by an AC eight-cycle (or its multiple) illuminating signal, the next by a four-cycle illuminating signal, the next by a two-cycle illuminating signal and the least significant bit by a one-cycle illuminating signal. If a selected pixel electrode is selectively charged during certain subframes, its luminescence will be a function of the combination of light emitted (or not emitted) during those times. This provides 16 different possible levels of luminescence for any pixel.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
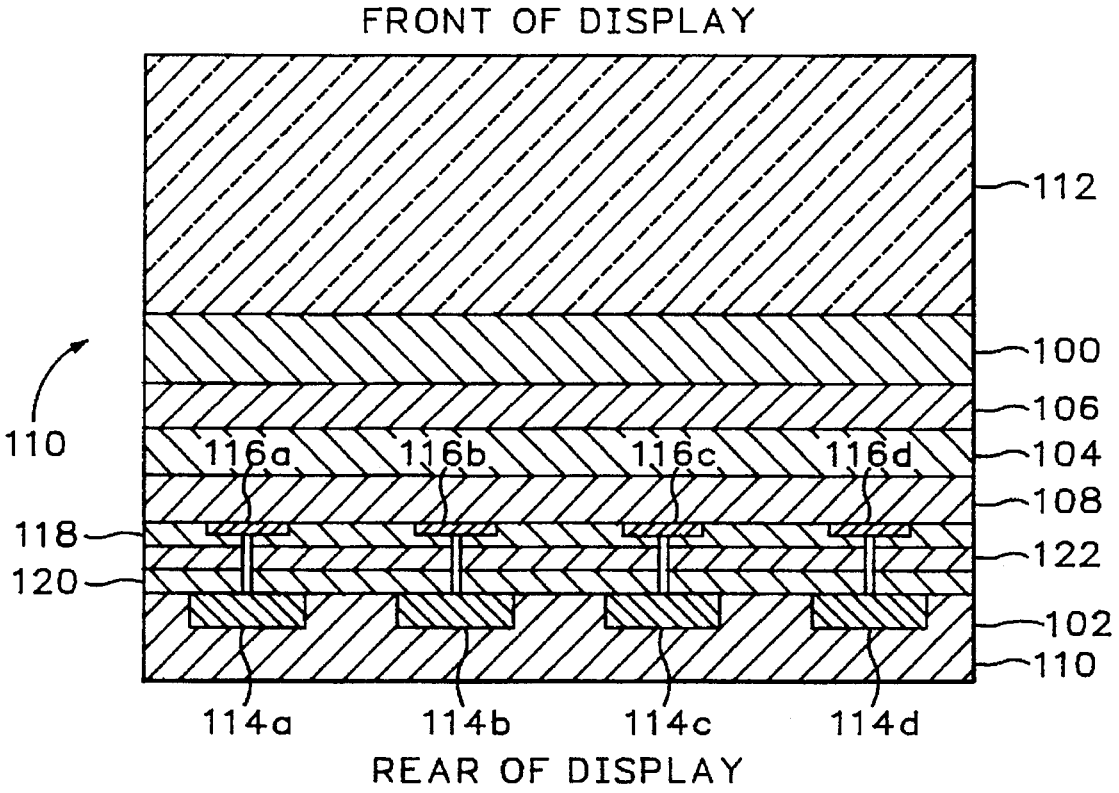
FIG. 1 is a cut away sectional representation of an inverted structure active matrix electroluminescent display constructed in accordance with the present invention.

Referring to FIG. 1, an active matrix electroluminescent device (AMEL) 101 is constructed using an inverted structure. The structure includes a transparent electrode layer 100, a circuit layer 102, and at least three EL layers including an electroluminescent phosphor layer 104 sandwiched between front and rear dielectric layers 106 and 108, respectively. Alternatively, either the rear dielectric layer 108 or the front dielectric layer 106 may be omitted. The EL three layers are disposed between the circuit layer 102 and the transparent electrode layer 100. The circuit layer is deposited on a rearwardly disposed substrate 110. The rearwardly disposed substrate 110 is preferably a high purity silicon in which the circuit layer 102 is fabricated. A front glass plate 112 is affixed on the transparent electrode layer 100. The individual circuit elements 114*a*, 114*b*, 114*c* and 114*d* are connected to respective pixel electrodes 116*a*, 116*b*, 116*c* and 116*d*, with a metal line connected through a hole commonly referred to as a via in auxiliary ground layers. The auxiliary ground layers comprise a first isolation layer 118, a second isolation layer 120, and a ground plane layer 122, preferably made of refractory metals. The isolation layers 118 and 120 are preferably made of glass. The grounding for the individual circuit elements 114*a*–114*d* is preferably the rearwardly disposed substrate layer 110 or the ground plane layer 122.

Figure 2:
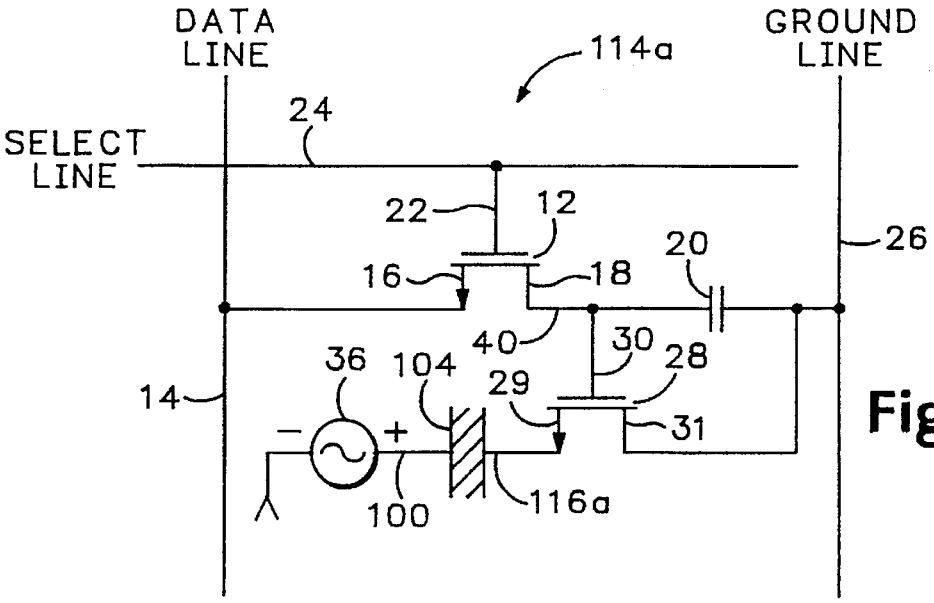
FIG. 2 is an electrical schematic of an active matrix electroluminescent circuit element, including a ground line.

FIG. 2 is an electrical schematic of a circuit element 114*a* of the active matrix electroluminescent device 101 for selectively illuminating a respective pixel. A low voltage transistor 12, that is designed to handle signals up to the range of about 20 volts, gates a data signal (voltage signal) from a data line 14 connected to the low voltage transistor's source 16 to the low voltage transistor's drain 18. The drain 18 is connected to a hold capacitor 20, which in turn is connected to a ground line 26. In an actual fabricated AMEL device, the capacitor 20 is not generally fabricated as a discrete element, but is the capacitance of the line 40 between the low voltage transistor's drain 18 and a high voltage transistor's 28 gate 30, coupled to the ground line 26. The gate 22 of the low voltage transistor 12 is connected to a select line 24 to activate the low voltage transistor 12 to permit the selective gating of the data signal to the hold capacitor 20 for temporary storage. After gating the data signal to the hold capacitor 20, the select line 24 is typically then deselected, thereby isolating the hold capacitor 20 from the data line 14. The capacitor 20 maintains the applied voltage for a sufficient period of time for the illumination of a pixel. The capacitor 20 is also connected to the gate 30 of the high voltage transistor 28, which is designed to withstand voltages in the range of about 200 volts between its terminals. The high voltage transistor's drain 31 and source 29 are respectively connected between the ground line 26 and a respective pixel electrode 116*a*. The front electrodes 100 carry a high AC voltage illumination signal powered by a voltage driver 36. By activating the base 30 of the high voltage transistor 28 with the electrical charge stored in the hold capacitor 20, after the low voltage transistor 22 has been deactivated or by the data signal directly when the low voltage transistor 12 is activated, the pixel electrode 116*a* is electrically connected to the ground line 26 by the high voltage transistor 28. By connecting the pixel electrode 116*a* to the ground line 26, an electric field is created between the respective portion of the front electrodes 100 and the pixel electrode 116*a*, causing light to be emitted from the interdisposed electroluminescent layer 104.

Figure 3:
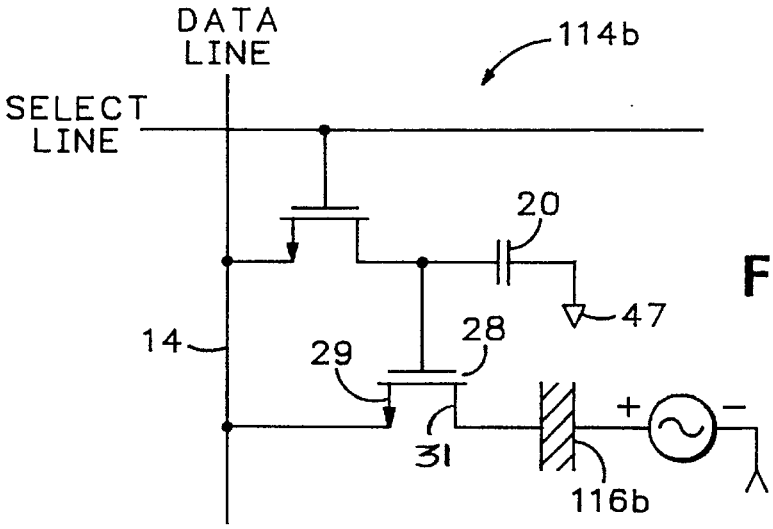
FIG. 3 is an electrical schematic of an alternative active matrix electroluminescent circuit element, wherein the source of the high voltage transistors is connected to a data line.

FIG. 3 is an alternative circuit element design 114*b* of FIG. 2, which involves connecting the source 29 of the high voltage transistor 28 to the data line 14, the drain 31 to the pixel electrode 116*b*, and the capacitor 20 to a ground layer 47. The ground layer 47 is preferably the rearwardly disposed substrate 110 or the ground plane layer 122. Alternatively, the capacitor 20 could be connected to a ground line 26, as shown in FIG. 2.

Figure 4:
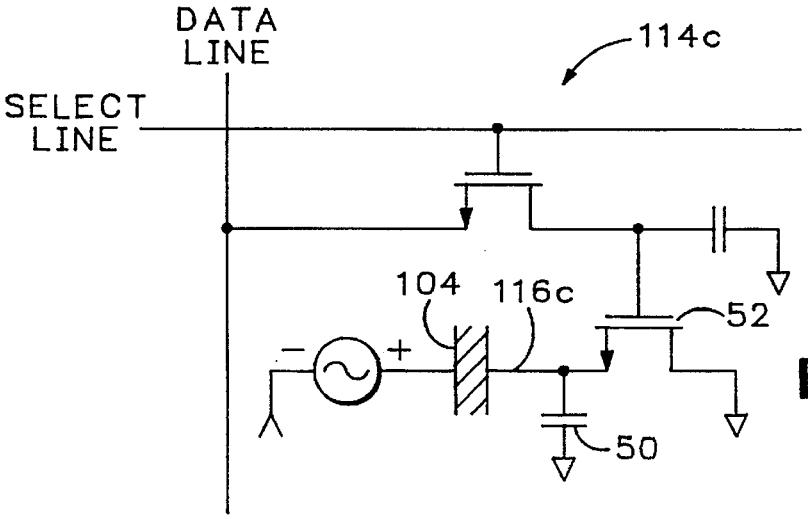
FIG. 4 is an electrical schematic of a two transistor, two capacitor, active matrix electroluminescent circuit element.

FIG. 4 is another alternative circuit design 114*c*, which involves using a two transistor two capacitor circuit. A capacitor 50 is provided between a high voltage transistor 52 and the pixel electrode 116*c*. Collectively, the capacitor 50 and the electroluminescent layer 104 act as a voltage divider reducing the voltage across the terminals of the high voltage transistor 52 when the transistor is off. The transistor 52, therefore, does not need to be designed to withstand the maximum applied voltage (200 volts).

Figure 5:
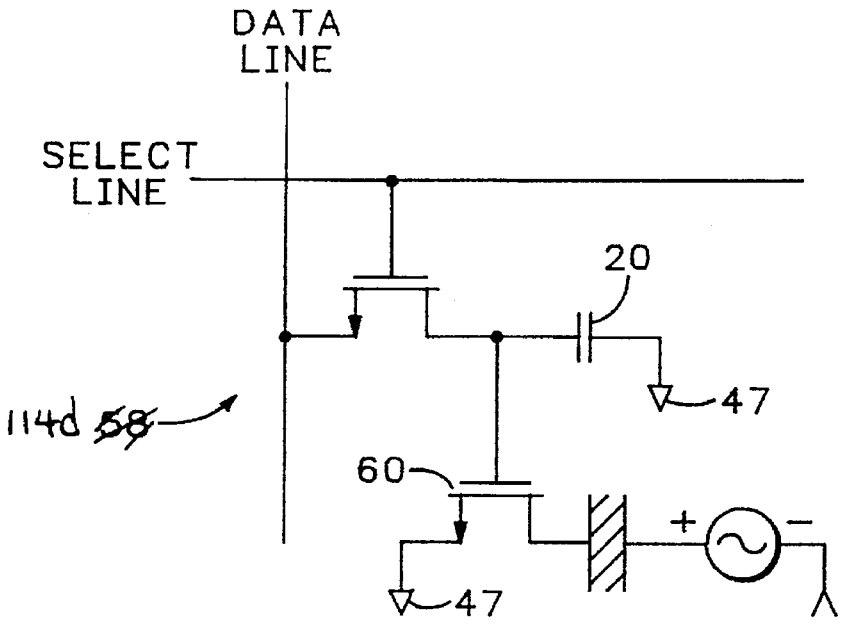
FIG 5 is an electrical schematic of another alternative active matrix electroluminescent circuit element.

FIG. 5 is still another alternative circuit element design 114*d*, which involves a high voltage transistor 60 operating in a breakdown region, and the capacitor 20 and the high voltage transistor 60 connected to a ground layer 47. Preferably, the high voltage transistor 60 maintains 80 volts across its terminals which prevents the electroluminescent layer from emitting light when deactivated.

Figure 6:
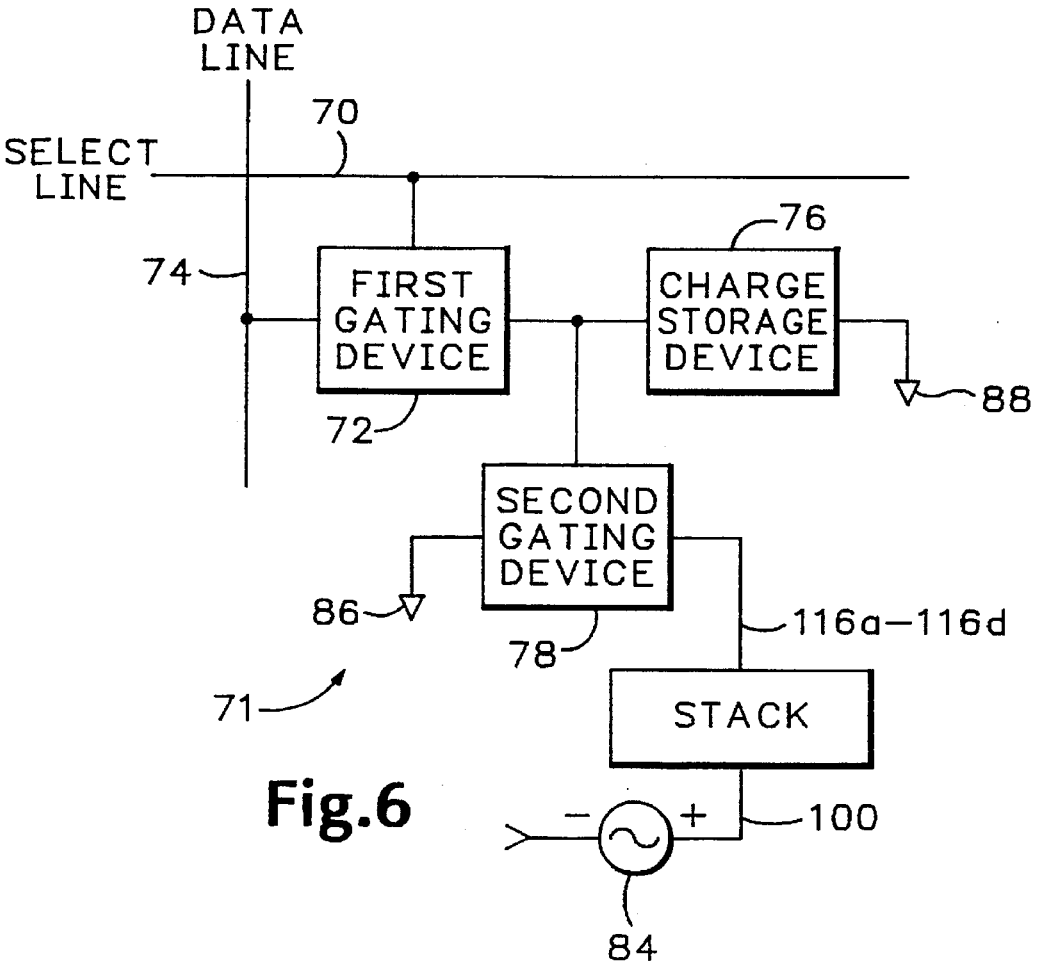
FIG. 6 is a functional block diagram of an active matrix electroluminescent circuit element.

FIG. 6 is a functional block diagram of a circuit element 71. The select line 70 is activated causing a first gating device 72 to connect the data line 74 to a charge storage device 76 which in turn is connected to aground 88. The charge storage device 76 is connected to and activates a second gating device 78 for connecting a pixel electrode 80 to a ground 86. The grounds 86 and 88 may be any suitable ground, such as a ground line 26, ground plane layer 122, grounded data line 74, or substrate 110. During activation of the second gating device 78, the interdisposed electroluminescent layer 104 between the front electrodes 100 and a respective pixel electrode 116*a*–116*d* is illuminated by a voltage driver 84. Using the combination of the first gating device 72, the charge storage device 76 and the second gating device 78, allows for the temporary storage of a data signal from the data line 74 for the illumination of a respective pixel. The key aspect of the active matrix electroluminescent display is a circuit element which can be selected to store or erase the pixel data voltage signal.

Figure 7:
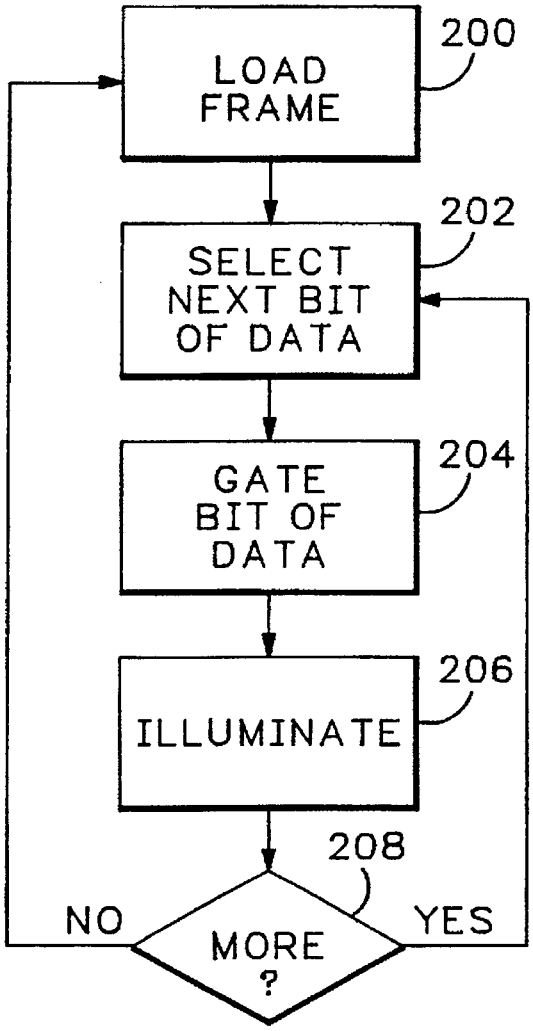
FIG. 7 is a flow chart of an exemplary method for achieving a gray scale using an active matrix electroluminescent display in accordance with the present invention.

FIG. 7 is an exemplary flow chart for achieving a gray scale display in accordance with the present invention. A frame of data consisting of a plurality of subframes, each of which contains one data bit of gray scale information, is loaded into memory at block 200 representative of the desired luminescence for each individual pixel of the display. Preferably, the data bits are arranged in order from the most significant bit to the least significant bit representative of a numerical value. Alternatively, the data bits may be arranged in any predetermined order or even a random order. A data bit is selected at block 202 from the frame for illumination of a pixel. At block 204, the data bit is gated from the first gating device 72 to the second gating device 78 by activation of the select line 70 coupled to the first gating device 72. The second gating device 78 is selectively activated depending upon the value of the data bit. At block 206, an illumination signal energizes the front electrodes 100 for a predetermined period of time, preferably with voltage pulses, for illuminating the pixel within the electroluminescent layer. The period of time of illumination varies from subframe to subframe and is preferably consistent with the value of the location of the data bit in the frame. In other words, in a frame of four data bits the most significant data bit would correspond to a duration twice the next significant bit, four times the next less significant bit, and eight times the least significant bit. Alternatively, any other scheme could be used to assign a time duration of the scanning signal and, hence, illumination, to each data bit within the frame. Block 208 checks to see if all the data bits in the frame have been used. If there are additional data bits left to be used in the frame, then control is passed back to block 202 and the next data bit in the frame is processed. Alternatively, if there are no data bits left to process in the frame, then control is passed to block 200 to load the next frame of data for the respective pixel. By selecting a timing scheme for the duration of the illumination pulses for each subframe within a frame, in other words, a weighting scheme, and providing the appropriate data bits for the frame, a gray scale display with different luminescence levels can be achieved.

It is readily apparent that for an entire display, each pixel electrode within the display would have its own frame of data and could be addressed during an addressing period. The desired luminescence of each pixel for each refresh period is indicated by the data in each subframe, which in total comprise a frame. The luminescence output of each subframe within a frame combine together to provide the gray scale display.

Figure 8:
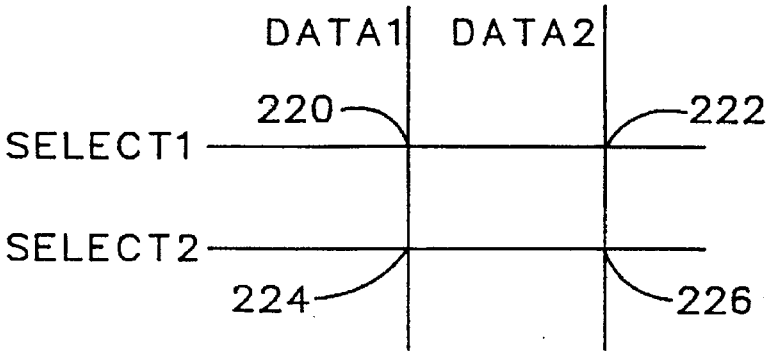
FIG. 8 is a representation of a pixel matrix comprising a four node display.
Figure 9:
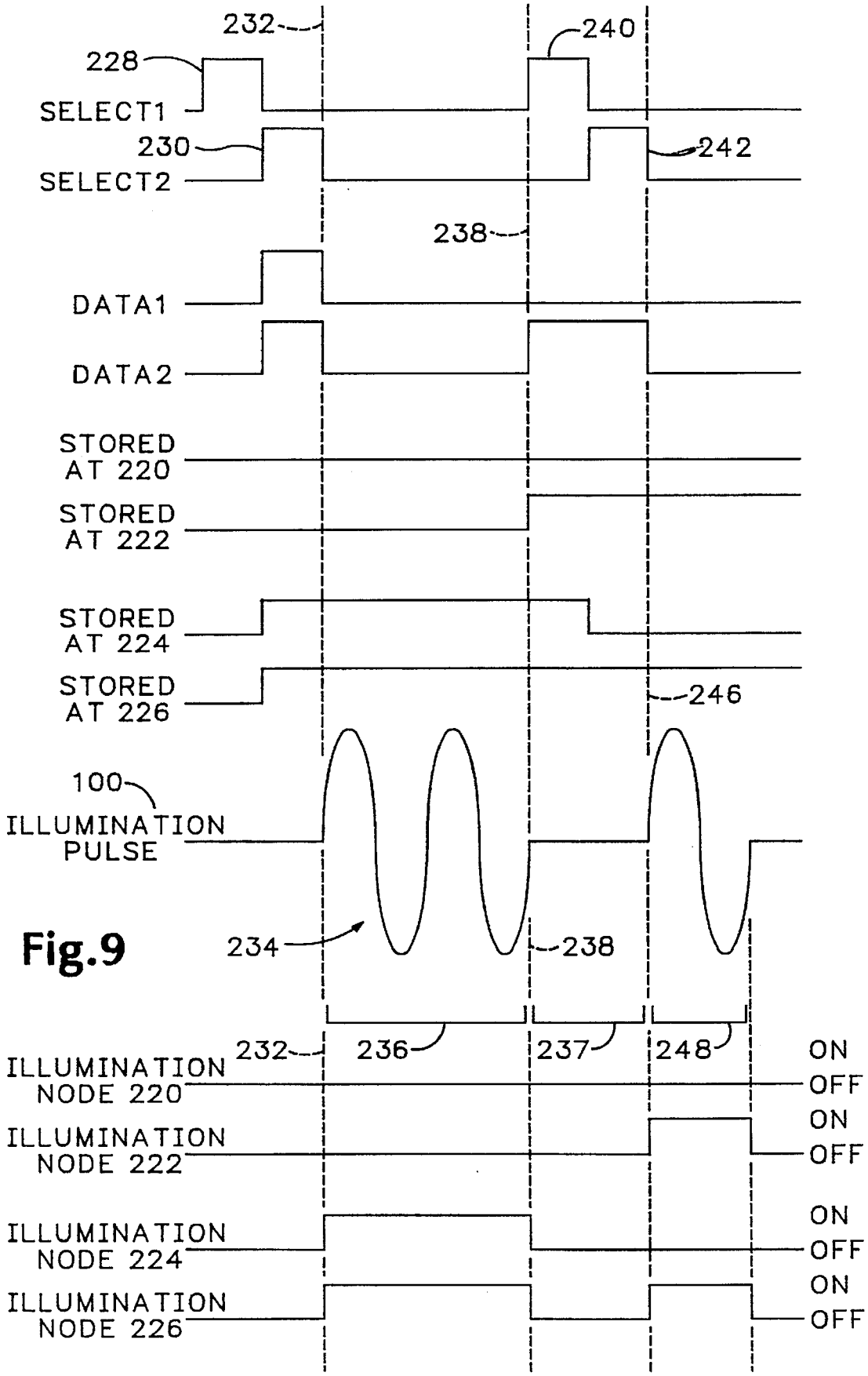
FIG. 9 is an exemplary timing diagram for achieving a gray scale in accordance with the present invention.

FIG. 9 is an exemplary timing diagram of a frame with two data bits (subframes) for a four node 220, 222, 224, 226 display having two data lines (data1, data2) and two select lines (select1, select2) as shown in FIG. 8. Select1 is activated with a voltage pulse 228 while both data1 and data2 have low voltages, resulting in a low voltage stored at node 220 and node 222. Next, Select1 is deactivated and Select2 is activated with a voltage pulse 230 while data1 and data2 both have a high voltage, resulting in a high voltage stored at node 224 and node 226. At this point in time after an addressing period of time, all the data for the nodes 220, 222, 224, 226 have been gated from the first gating device 72 to the second gating device 78 for the illumination of selected pixels. The data is maintained by the memory characteristic of the pixel circuit. At time 232 the front electrodes 100 are energized with a series of illumination pulses 234 for a predetermined period of time 236 illuminating nodes 224 and 226 which were selected. The front electrodes 100 are then deactivated at time 238 and the next subframe of data bits is loaded with the second bit of information from the respective frame for each pixel, to each pixel within the display, during an addressing period of time 237. Select1 is activated with a voltage pulse 240 while data1 and data2 respectively have low and high voltages, resulting in node 220 having a low voltage and node 222 having a high voltage. Select1 is deactivated and select2 is activated with a voltage pulse 242 while data1 has a low voltage and data2 has a high voltage, resulting in a low voltage at node 224 and a high voltage at node 226. After the addressing period 237, the illumination pulse 100 is activated at time 246 for a period of time 248 illuminating nodes 222 and 226 which were selected.

As illustrated in FIG. 9, with two data bits there are four gray levels that can be generated. Here, the illumination period 236 is twice the illumination period 248. Node 220 has a 0 gray level because it was never illuminated. Node 222 has a gray level of 1 because it was illuminated only during the shorter illumination period 248. Node 224 has a gray level of 2, which is twice that of node 222, because it was illuminated only during the longer illumination period 236. Node 226 has a gray level of 3, because it was illuminated during both illumination periods 236 and 248. It is apparent that with a larger number of subframes within the frame, many different combinations of illumination periods can be used to create a high number of gray levels for the display. The data bits may be arranged in any order, and the illumination pulses may be at any frequency or duration desired, to achieve the desired illumination. Also, the subframe may be chosen in any order desired.

The separation of the addressing function of the pixels from the illumination function, permits the display to be illuminated at frequencies not possible with a traditional display. Illumination voltage pulse frequencies may occur at 10,000 Hz or more. Depending upon the circuit design used and the timing requirements of the display, the illumination and addressing functions may be separated as shown in FIG. 9, or alternatively occur simultaneously with one another eliminating the time required to address the entire display.

The voltages pulses applied to the display are preferably identical to each other and have a magnitude near the upper end of the voltage versus luminescence curve (e.g., 200 volts or whatever voltage is near the upper end of the curve depending upon particular display design). The voltage versus luminescence curve does not tend to vary, from location to location and display to display, nearly as much at higher voltage levels (e.g., 200 volts) than at low and intermediate voltage levels. Additionally, such voltage pulses reduce the effects of the voltage coupling between pixels, because slight variations in a large voltage in the less variable region of the voltage versus luminescence curve does not have much effect on the luminescence of a pixel. With a greater control over the luminescence of the pixels within the display, a higher gray scale is achievable.

The circuit designs shown in FIGS. 2–6 provide either an off pixel or a pixel that is illuminated with the voltage applied to the front electrodes 100 which is preferably 200 volts which minimizes the nonlinear voltage versus luminescence curve and voltage coupling effects.

Figure 10:
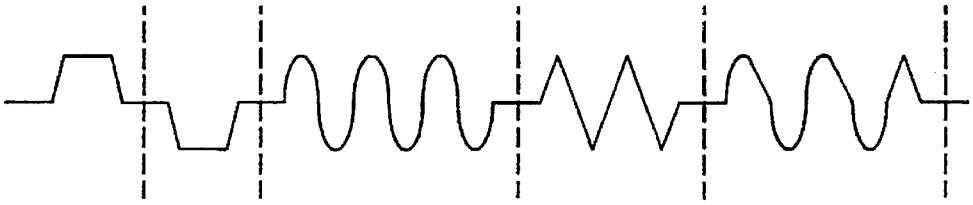
FIG. 10 is a wave form diagram of an illuminating signal having variable voltage pulse wave shapes.
Figure 11:
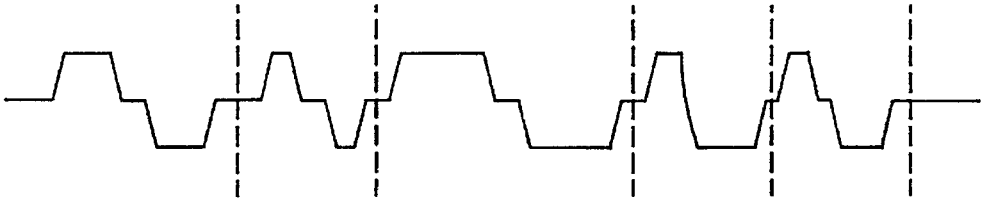
FIG. 11 is a wave form diagram of an illuminating signal having a variable voltage pulse width.
Figure 12:
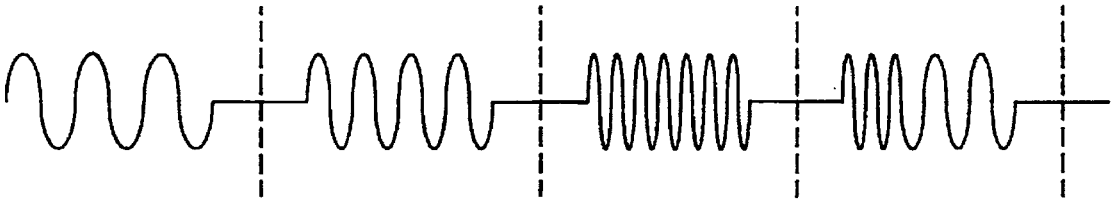
FIG. 12 is a wave form diagram of an illuminating signal having a variable voltage pulse frequency.
Figure 13:
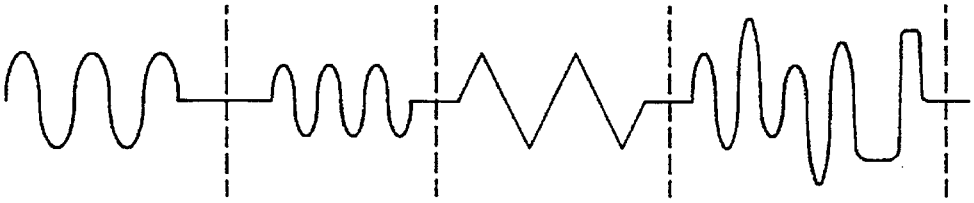
FIG. 13 is a wave form diagram of an illuminating signal having a variable voltage pulse amplitude.

Furthermore, the luminescence can also be controlled by varying the shape of the voltage pulses (FIG. 10), the pulse width (FIG. 11), the pulse frequency (FIG. 12), the pulse amplitude (FIG. 13), or other gray scale techniques. Preferably, such additional techniques are used in combination with the previously described gray scale display to adjust the pixel luminescence within different subframes of differing time durations. Alternatively, such additional techniques may be used within different subframes of the same time duration to vary the luminescence of the pixels to achieve a gray scale display. Such modifications might be used for gamma corrections to create a gray scale display to compensate for the nonlinear light levels detected by the eye.

Figure 14:
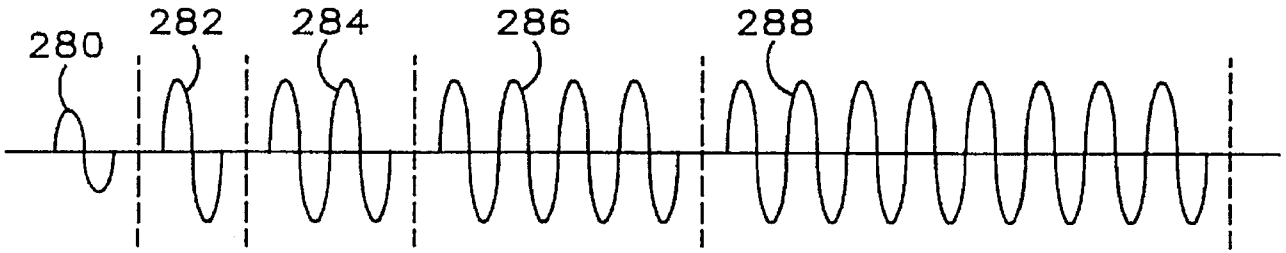
FIG. 14 is a wave form diagram of an illuminating signal having a reduced amplitude first pulse.

Referring to FIG. 14, an alternative technique is shown to achieve a gray scale display. In the first subframe, a first voltage pulse 280 has a reduced amplitude to generate a luminesce that is preferably of one half that of a maximum luminesce. In the second sub-frame, a second voltage pulse 282 has a greater magnitude than the first voltage pulse 280 to generate the maximum luminesce. A voltage pulse of 180 volts generates maximum luminesce, while a voltage pulse of 160 volts generates half the maximum luminesce. The remaining subframes use voltage pulses 284, 286 and 288, each respectively including twice as many voltage pulses than the immediately preceding subframe, to generate a gray scale display. Using voltage pulses of the same magnitude to achieve a thirty two gray level display (five subframes) requires thirty one voltage pulses and the associated time duration to energize each of the voltage pulses. A thirty two gray level display using this alternative technique of a reduced amplitude first voltage pulse 280 only requires sixteen voltage pulses and the associated time duration to energize all of the voltage pulses is consequently reduced. Accordingly, this alternative technique significantly increases the number of gray levels possible within a given frame rate.

Figure 15:
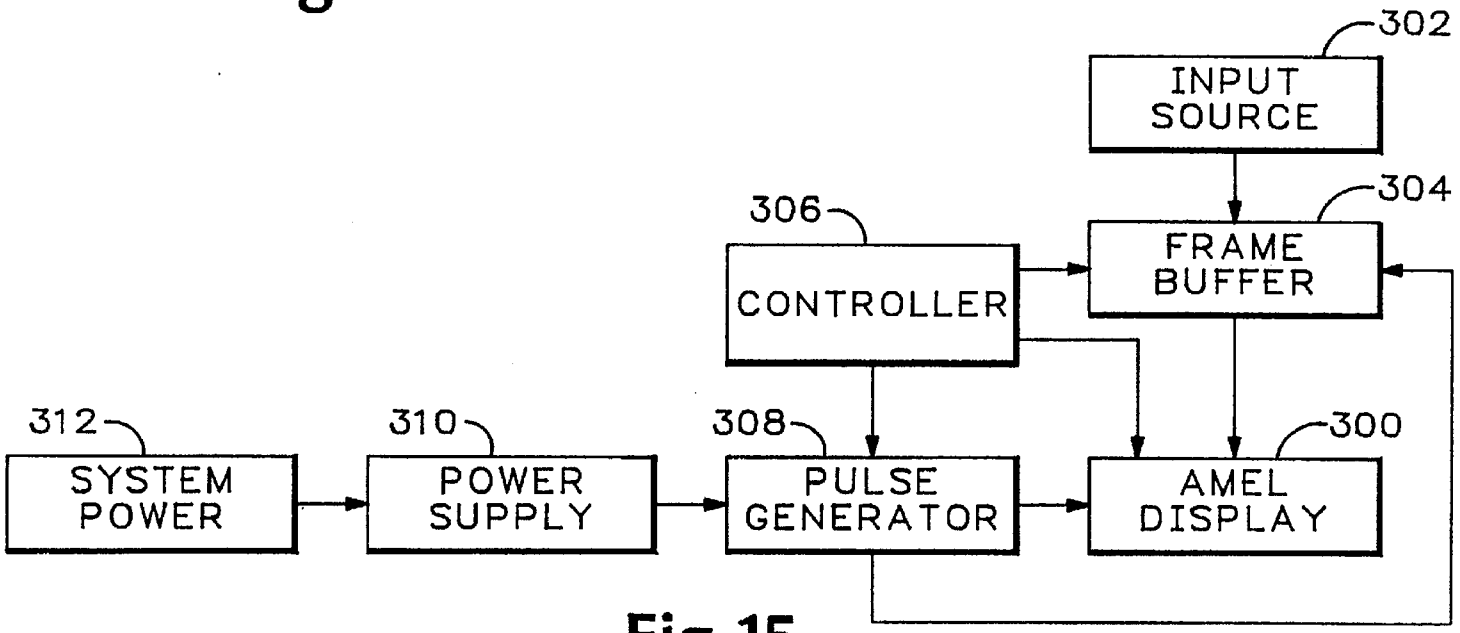
FIG. 15 is a schematic block diagram for the generation of a gray scale AMEL display.

FIG. 15 shows a schematic block diagram for the generation of a gray scale AMEL display 300. An input source 302, such as a computer or sensor, provides data indicative of the desired gray scale data to the display. The data is received by a frame buffer 304 and is reformatted and sent to the AMEL display 300 based on the control signals from a controller 306. In other words, the controller 306 instructs the frame buffer 304 to write selected data to the AMEL display 300. The controller 306 also instructs a pulse generator 308 to generate voltage pulses of the desired wave shape, amplitude, frequency, and time duration. The voltage pulses make up the illumination signal provided to the AMEL display 300. A power supply 310 provides the needed voltage levels to the pulse generator 308. The controller 306 also provides timing controls to the AMEL display 300. The required voltages for the power supply 310 are provided by the system power 312 which could include, for example, a battery or wall plug.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of illuminating an active matrix electroluminescent device to provide a gray scale display, said device comprising a first electrode layer comprising an active matrix of individually addressable pixel electrodes, a second electrode layer, and a thin film electroluminescent laminate stack including at least a nongaseous electroluminescent phosphor layer which produces light upon the application of an electric field across the phosphor layer and a dielectric layer, said stack being disposed between said first and second electrode layers, comprising the steps of:

(a) selecting a set of selected ones of said pixel electrodes with data signals during the first subframe time period of a frame;

(b) driving said second electrode layer during said first subframe time period with a first illumination signal having predetermined characteristics including frequency, amplitude and wave shape to simultaneously illuminate all pixels within said nongaseous electroluminescent phosphor layer associated with said set of said selected ones of said pixel electrodes;

(c) selecting at least one of said set of said selected ones of said pixel electrodes with data signals during a subsequent subframe time period of said frame; and (d) driving said second electrode layer during said subsequent subframe time period with an altered illumination signal wherein one or more of said predetermined characteristics differ from the first illumination signal to simultaneously illuminate all pixels within said nongaseous electroluminescent phosphor layer associated with said at least one of said set of said selected ones of said pixel electrodes.

2. The method of claim 1, further including the steps of repeating steps (c) and (d) for n subsequent subframe time periods until an entire frame of data has been written.

3. The method of claim 1 wherein said illumination signal of step (b) and the altered illumination signal of step (d) are voltage pulses having an amplitude in the range of 160 volts.

4. The method of claim 1 wherein there is a time delay between the execution of step (b) and the execution of step (d).

5. The method of claim 1 wherein the amplitudes of the first and altered illumination signals, respectively, are different.

6. The method of claim 5 wherein the amplitude of the altered illumination signal is greater than the amplitude of the first illumination signal.

7. The method of claim 1 wherein the frequencies of the first and altered illumination signals, respectively, are different.

8. The method of claim 1 wherein the wave shapes of the first and altered illumination signals, respectively, are different.

9. The method of claim 1 wherein the amplitude of the first illumination signal is varied during the first subframe time period.

10. The method of claim 1 wherein the frequency of the first illumination signal is varied during the first subframe time period.

11. The method of claim 1 wherein the wave shape of the first illumination signal is varied during the first subframe time period.

12. The method of claim 1 wherein the respective amplitudes of the first and altered illumination signals are selected such that light produced by pixels in said matrix is approximately half as bright during said first subframe time period than during said next subframe time period.

* * * * *